US011085162B1

(12) United States Patent
Miller

(10) Patent No.: US 11,085,162 B1
(45) Date of Patent: Aug. 10, 2021

(54) DEVICE, METHOD, AND SYSTEM FOR REDUCING EARTH PRESSURES ON SUBTERRANEAN STRUCTURES

(71) Applicant: Roger G Miller, Sheboygan, WI (US)

(72) Inventor: Roger G Miller, Sheboygan, WI (US)

( * ) Notice: Subject to any disclaimer, the term of this patent is extended or adjusted under 35 U.S.C. 154(b) by 0 days.

(21) Appl. No.: 16/373,223

(22) Filed: Apr. 2, 2019

(51) Int. Cl.
*E02D 5/20* (2006.01)

(52) U.S. Cl.
CPC ..... *E02D 5/20* (2013.01); *E02D 2200/12* (2013.01); *E02D 2200/14* (2013.01); *E02D 2300/0046* (2013.01)

(58) Field of Classification Search
CPC ..... E02D 5/20; E02D 2200/12; E02D 2200/220014
USPC ..... 52/169.1
See application file for complete search history.

(56) References Cited

U.S. PATENT DOCUMENTS

| | | | | |
|---|---|---|---|---|
| 5,505,563 | A * | 4/1996 | Curt | E02D 5/20 405/262 |
| 6,240,700 | B1 * | 6/2001 | Sheu | E02D 5/20 405/267 |
| 6,280,120 | B1 * | 8/2001 | Okamoto | B05D 5/08 405/232 |
| 2008/0107852 | A1 * | 5/2008 | Rubb | C08J 9/20 428/36.5 |
| 2010/0248574 | A1 * | 9/2010 | King | D03D 15/04 442/205 |
| 2014/0082864 | A1 * | 3/2014 | Chandra | E01D 19/02 14/26 |
| 2017/0030041 | A1 * | 2/2017 | Hargrave | E02D 3/12 |
| 2018/0274200 | A1 * | 9/2018 | Weinstein | E02D 31/004 |

* cited by examiner

*Primary Examiner* — Paola Agudelo
(74) *Attorney, Agent, or Firm* — Mandy L. Tran; Ceres Patent & Technology, LLC

(57) ABSTRACT

The present inventive subject matter pertains to a device, system, and method that provides a buffer support for buried structures in response to lateral and vertical earth pressures of backfill material. The device having shaped form is able to provide timely response so as to reduce earth pressures of the backfill material exerted onto the buried structure. These behavioral features further enabling an effective geofoam device to be produced in thin proportion that conforms with industry standards.

5 Claims, 12 Drawing Sheets

Cross-Section of Shape E (EPS 11)

(EXAMPLE OF PRIOR ART DEVICE)

[1]Dawkins, E., & Ramos, R. (2016). Determination of Earth Pressure and Displacement of the Retaining Structure According to the Eurocode 7-1. *Proceedings of 19th Baltic Sea Geotechnical Conference*. doi:10.3846/13bsgc.2016.020.

Shape E (EPS 11) Foam Application
(Along Tall Buried Foundation Wall with MSE Reinforcement)

Cross-Section of Shape E (EPS 11)

DEVICE, METHOD, AND SYSTEM FOR REDUCING EARTH PRESSURES ON SUBTERRANEAN STRUCTURES

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

CROSS REFERENCES

This application is a non-provisional utility patent application claiming benefit of priority to and incorporating by reference in full the provisional patent application No. 62/651,716, filed Apr. 2, 2018, in accordance with 35 U.S.C. § 119.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

FIELD OF THE INVENTION

The present inventive subject matter pertains to a geofoam device and system that assists in the reduction of lateral earth pressures on subterranean structures against backfill material and overburden.

BACKGROUND OF THE INVENTION

It is common practice in civil engineering and building construction to design structures with enough strength to withstand earth pressures without reduction by a buffer zone. The task is not without challenge against typical large and variable loads. There is considerable prior art on this subject that makes use of "geofoam" as a means to reduce the magnitude and variance in micro-environmental loads exerted on a buried structure (Stark, Bartlett, & Arellano, 2012). See, Stark, T., Bartlett, S., & Arellano, D., Expanded Polystyrene (EPS) Geofoam Applications & Technical Data, EPS Industry Alliance, 2.9 (2012).

Geofoam commonly consists of expanded polystyrene (EPS) to limit earth stresses exerted on structures. It is used as ultra-lightweight fill at densities typically in the range of just 0.70 to 2 pcf (pounds per cubic foot).

For many decades starting in northern Europe in the 1970's, large volumes of geofoam blocks have been used to buffer underground structures from vertical and lateral loading pressures of soil mass. These blocks range in thickness and width by units of feet. Although most commonly used to reduce vertical loads for the purpose of limiting subsidence of soft ground under structures and roadways, large volumes of geofoam block can also be used to limit lateral earth pressure on structures if the underlying soil surface is shaped within its "angle of repose" so that the soil underlying the geofoam volume is in itself stable against sliding or slope failure. See FIG. 1, EPS Block Diagram, credit EPS Industry Alliance.

Other prior art includes U.S. Pat. No. 5,713,696 which discloses a geofoam device and method that comprises less volume of EPS material than previously described by multiple layers of materials with different properties (Horvath & Wagoner, 1998).

Foam material, as a general treatment in architecture, has primarily and historically served the function of insulation. For example, both extruded polystyrene (XPS) and expanded polystyrene (EPS) foam board are commonly used to provide thermal insulation on either the exterior or interior face of structures. While XPS foam is an effective insulating material, the manner of its manufacture is not amenable to production for geofoam production. Due to its material composition and inherent physical attributes, XPS is too rigid for purposes of serving as a stress-strain buffer against underground lateral earth pressures.

Effective prior art applications for the purpose of load reduction have failed to explore beyond a certain superficial range of geofoam product behavior, utilizing only a small range of elastic strain capability not yet having attempted to utilize the full range behavior and attributes of foam to pressure interactions. Currently in the art it is not possible to achieve sufficient underground buffer for an underground wall or structure against vertical and lateral earth pressures without added thickness to the foam beyond that required to provide the desired amount of thermal insulation. There remains a need in the art to capture the full range of capability of geofoam technology for a thinner and more easily transportable product with enhanced adaptability to the wide variety of environmental demands.

SUMMARY OF THE INVENTION

The invention herein relates to a device and system that provides improved stress-strain buffer support and reactionary support against various subterranean environmental pressures, particularly lateral earth pressures, for underground architecture. Specifically, a device and system having an effect that improves on the prior art but embodied in thinner portions for commercial ease.

In order to exercise a greater range of compressive stress-strain behavior of foam materials than that of prior art, the properties throughout the full potential range of strain behavior, from small amounts of strain within the elastic range, throughout the long term continuing compressive creep, and into a third range of large compression within which the cellular structure of the foam is collapsing, must first be accurately characterized by performing physical tests. This is more complex than testing many other common building materials because the stress-strain properties of synthetic plastic cellular foam materials are time dependent. The stress response for these materials is much greater for rapidly applied strain rates than it is for slowly applied strains. Similarly, under any fixed amount of compressive strain that is applied, the responding stress decreases over time. Herein this is referred to as "stress relaxation". The rate of stress relaxation is initially quite rapid, but decreases over time at a diminishing rate that is linearly proportional to the numeric logarithm of elapsed time. And for any amount of constant stress that is applied beyond the initial elastic range, increasing amounts of compression continue but at similar diminishing rate over time. This is referred to as "compression creep". To characterize the full range of time dependent stress-strain behavior, evaluation of any candidate foam material must include tests of both short duration as well as long term duration such as presented in FIG. 2—Flat Board Stress-Strain Time Dependent Compression of EPS-15 (0.9 pcf).

While the common ASTM D1621 Standard Test Method for Compressive Properties of Rigid Cellular Plastics is convenient in that it takes just minutes to perform, it doesn't begin to develop the long-term time dependent behavior because it is standardized at the quite rapid strain rate of 10% per minute. And the long-term testing that is recommended for the purpose of assuring that long term compressive creep is avoided in foam insulation applications focuses on identifying just the threshold that creep begins to occur (in ASTM C165-Standard Test Method for Measuring Compressive Properties of Thermal Insulation), which is commonly limited to only about 2% strain in EPS foam. So common testing practice doesn't provide complete understanding amongst foam manufacturers or material testing laboratories of the full range of potential stress-strain behavior into large ranges of strain in the synthetic plastic cellular foam materials commonly being produced, much less relate that to commensurate amounts of shear strain that must be developed in earthen backfill materials to reduce earth pressures against structures.

Lateral earth pressures normally exerted by earthen backfill materials at increasing depth against structures is proportional to the unit weight (bulk density) of the backfill material, the depth of backfill at any point, and the two to three dimensional relationship of states of stress within the backfill material as is characterized by the "lateral earth pressure coefficient". This has been well studied in geotechnical engineering practice (and is summarized in detail in Determination of Earth Pressure and Displacement of the Retaining Structure According to the Eurocode 7-1, Eugeniusz Dembicki, Bogdan Rymsza, 2016). In the case where a buried structure is non-displacing, meaning that it isn't allowed to move away some small amount from the backfill material as is the case for building basement walls, the lateral earth pressure coefficient is termed the "at rest" condition by geotechnical engineers and is represented by the symbol Ko. This value is recognized for common conditions at being equal to the numeric value of (1-sin (phi)), with phi representing the "internal angle of soil friction" that is characteristic of any particular earthen backfill material. The internal angle of soil friction commonly ranges from 30 to 36 degrees angle in sand materials, to as much as 40 degrees or slightly more for angular gravel. So common values of "at rest" (Ko) lateral earth pressures range from 0.5 down to 0.35. As example, if a particular sand backfill material has a bulk density of 130 pcf (pounds per cubic foot) and internal angle of soil friction of 34 degrees, the "at rest" lateral earth pressure coefficient is 0.44 and the lateral earth pressure exerted against a non-displacing wall is (0.44*130)=57 pcf times the depth for each foot of backfill depth. In architectural parlance, this example backfill material exerts a lateral earth pressure of 57 pcf of "equivalent fluid pressure" (EFP). At just a couple of feet depth the resulting lateral earth pressure is 114 psf (pounds force per square foot) of wall area. At eight feet depth the lateral earth pressure is 456 psf. The resulting pressure profile, with an appropriate "load factor" or "safety factor" applied to it as required by judgment or building code (which is 1.7 for lateral earth loads for reinforced concrete design), defines the pressure profile that the wall must be designed to withstand. So this example wall needs to be designed to have enough strength to resist a pressure profile that ranges from 194 psf at two feet depth, increasing to 775 psf at eight feet depth in order to provide some reserve strength to withstand potential actual forces as they may vary due to various environmental factors. These are quite large pressures. However, if the wall is allowed to move a very small amount away from the backfill, as is tolerated in the design of many free-standing retaining walls, the lateral earth pressure is substantially less, as next described.

In cases where a wall is allowed some minor amount of displacement or rotation away from the backfill material, the lateral earth pressure is substantially less than the "at rest" earth pressure and is referred to as the "active" lateral earth pressure, represented by symbol Ka. The numerical value of Ka is equal to the numerical value (tan^2(45-phi/2). For the same sand material described above with an internal angle of soil friction of 34 degrees, Ka=0.28, which is just 64% of the pressure exerted by the "at rest" condition and requires only that much designed wall strength in comparison. This reduction of lateral earth pressure from the "At Rest" to the "Active" condition is illustrated in FIG. 3—Lateral Earth Pressure Profile for Backfilled Wall.

In order to achieve a reduction in lateral earth pressure exerted by backfill against a non-deforming stationary structure by introducing a geofoam device in between the structure and the backfill placed against it in order to reduce the earth pressure from the "at rest" to the "active" condition, the stress-strain properties of the geofoam device must be compatible with the stress-strain properties of the backfill material. The inventor herein having extensively researched this inquiry, has discovered the ability to manipulate certain features of plastic synthetic cellular foam material, particularly here expanded polystyrene (EPS), to create a unique combination of ranges in stress-strain of behavior (also referred to herein as Zones) not otherwise achievable by current standards of the prior art. For purposes of this invention, the physical attributes of the material composition of this device should comprise synthetic plastic cellular foam material having the appropriate range of stress-strain properties for the range of stresses and deformations for common or any specific circumstance for reduction of earth pressure against a buried structure.

Note that the behavioral features described herein is not limited only to EPS foam however and has been seen among other equivalent types of plastic synthetic foam material. The invention herein providing a studied identified shape and manner of use that enables multiple ranges of stress-strain behavior of plastic synthetic foam material, particularly including without limitations to EPS foam material.

This invention recognizes the ability of synthetic plastic cellular foam material, preferably EPS foam, to deform at different capacities with different ranges of stress-strain behaviors in reaction to various extents of pressure (refer to A Viscoelastic-Plastic Bahavior Analysis of Expanded Polystyrene under Compressive Loading; Experiments and Modelling, Abdellarif Imad, 2001). There are three identified performance ranges as illustrated in FIG. 2. An essential explanation is provided as follows. These ranges are described herein as zones of reaction with respect to time and pressure. Zone 1 is referred to as the "Elastic" zone. Zone 1 as desired performance for purposes of this invention compresses within 0% to 2% compressive strain of the foam material in response to direct external pressure and has the ability to substantially regain its original dimension within this lower level of external pressure. Zone 2 is referred to as the "Compressive Creep" zone. Zone 2 as desired performance for purposes of this invention exhibits a resistive compression between approximately 2% to 70% compressive strain of the foam material in response to direct external pressure. Zone 2 is a more extensive zone or range of stress-strain reaction to cumulative external stress because the foam material is able to deform in resistive compressive manner in response to cumulative external pressure by a gradual "creep" like deformation over time. Zone 3 is referred to as the "Strain Hardening" zone. Zone 3 as desired performance for purposes of this invention exhibits a hardening of the foam material due to increasing degrees of collapse of its cellular structure typically occurring beyond 70% or more compressive strain of the foam material in response to direct external pressure. The graphical areas for these zones expressed as a percentage of compression experienced by EPS foam exposed to different degrees of pressure over time are illustrated in FIG. 2.

The "Elastic" feature as described for Zone 1 comprises the ability of the foam material to deform and immediately regain its original shape. The material exhibits the most elastic quality at this phase. Upon greater duration and degree of pressure, the foam will be less able to bounce back by its original elastic qualities, and will begin to compress in response to any greater pressure imposed. This phase of foam behavior is described as "Compressive Creep" because the foam material is acting in different manner in Zone 2, exerting a resistant force by the existing state of its physical integrity but at the same time giving into the applied pressures with gradual amount of compression and deformation continuing over time but at decreasing rate. Beyond this, further compressive strain causes increasing degrees of collapse of the foam's cellular structure resulting in a material that increasingly approaches the physical characteristics of the solid plastic material of which the foam is made. Initiation of cellular collapse is identified as Zone 3 behavior wherein the material is permanently compressed to a fraction of its original thickness. Throughout Zone 3 behavior increasing amounts of compressive stress are required to additionally compress the material. This is referred to as "strain hardening". The current typical problem of the existing art is due to the lack of utilization of Zone 2 stress-strain behavior, much less Zone 3, because the simple planar uninterrupted continuum of geometric foam blocks of the prior art would experience excessive long-term compressive strain if pressures exceeding their Zone 1 elastic behavior were applied.

The invention herein provides an improved product and system based on extensive experimentation and newly gained knowledge. To begin, this invention introduces a new device and method by which the full capacity of plastic synthetic foam performance, preferably EPS foam, is captured and manipulated to provide function including and extending beyond Zone 1 and importantly into Zone 2 of its stress-strain behavior. This inventive feature is achieved by manipulation of EPS foam material (or an equivalent compressible plastic synthetic foam material having the same manner of performance and behavioral qualities) to form sheets having a first planar side having a flat planar surface and on the opposite side a nonplanar side with a plurality of peaks (or alternative referred to as comprised in the form of protrusions) and valleys. Each said peak having a tapered cross-sectional shape starting at a base and terminating at a relatively narrowed tip, each valley defined by the space between two adjacent peaks. The first planar side being at least 1.0 inch thick for common applications, said second non-planar side being at least 0.5 inch thick between the base and tip of each peak of said plurality of peaks, wherein the total thickness of said solid sheet of foam material between said first planar side and second non-planar side is at least 1.5 inches thick. Each peak of said plurality of peaks having a cross sectional shape wherein the height is each said peak is ⅓ to 1½ times the width of its said base. Each valley comprising a space adjacent to a peak which begins at the base of said peak. The cross-depth or thickness of said non-planar side beginning from the base of each peak and terminating at the tip of the tallest peak thereon. The cross-sectional depth or thickness of said planar side is defined by the depth of the remaining planar sheet of plastic foam material from the base of said plurality of peaks rearward to the flat planar surface of said planar side. The first planar side is preferably 0.5 to 3 inches thick and may be greater than 3 inches thick. The total thickness of the solid sheet of foam material between its flat planar surface and the tip of the tallest peak of its plurality of peaks between its said first planar side and second nonplanar side is 1.5 inches and up to 4.5 inches thick but may be greater than 4.5 inches. The device in its entirety is preferably 1.5 to 4.5 inches thick between the planar and non-planar sides, but may be scalable to any size proportion. The variety of peak and valley shapes or quantity interspersed on the non-planar side of said geofoam sheet need not be uniform or confined to a particular geometric shape. The cross-sectional shape of each said peak may further be symmetrical or non-symmetrical. What is necessary to the implementation of this invention is for each peak to have a tapered cross-sectional shape that terminates at a relatively narrowed tip end. That each peak be separated from another peak by at least one valley. In this manner the surface is "shaped". An example embodiment of this is illustrated in FIG. 4—Cross Section of Shape C (EPS 15). The placement of its location in relation to a wall and backfill material is illustrated in FIG. 5. FIG. 6 depicts the portions within that cross section experiencing the range of stress-strain responses from Zone 1 through Zone 3 if the device is exposed to pressures that activate its full performance potential, and Table 1 describes those. FIG. 7 depicts the stress-strain relationships for this shape and EPS foam density as they vary throughout time and the embedded table summarizes the magnitudes of commensurate deformation in backfill materials needed to reduce lateral earth pressure from the "At Rest" to the "Active" condition. FIGS. 8, 9, and 10 are photographs of Shape C undergoing long term stress-controlled compression testing in the laboratory.

TABLE 1

| STRESS-STRAIN BEHAVIOR OF THE INVENTION | |
|---|---|
| ZONE 1 | Initial elastic, immediately recoverable, small amounts (typically less than 2%) of compression as a uniform stress-strain field within the continuum portion while also elastically rebounding in time varying amounts that partially compensates for some of the long term compressive "creep" occurring in adjacent Zone 2. |
| ZONE 2 | Incremental degrees of compressive strains beyond the elastic range that are not fully recoverable (form hysteretic stress-strain loops). The compressive creep that progresses over time in this stress range results in a relatively flat compressive stress-strain response long term in the foam material comprising the mid-height range of the invention's projections. This provides some of the deformation required to reduce lateral earth pressure, and also accommodates the time-dependent stress-strain response within the backfill material in order to sustain long term minimization of pressure exerted by the backfill on the structure. |
| ZONE 3 | Initiation and increasing collapse of the cellular structure of the foam comprises the "strain hardening" Zone 3 of behavior at those localizations of high stress. |

Standard foam block design of the prior art when used as subterranean support is only able to provide compressive support within Zone 1 without resulting in excessive long term compressive strain because the continuum of uninterrupted foam cross section results in a uniform stress field throughout the entire thickness of the blocks. Stress application extending into Zone 2 behavior in an uninterrupted continuum resulting in long term compressive reserves no region of Zone 1 behavior available to compensate by rebounding. So blocks of uninterrupted continuum of foam must be sufficiently thick for their elastic (Zone 1) response to provide all of the necessary amount of shear strain deformation in an earth backfill material to reduce lateral earth pressure from the "At Rest" to the lessor "Active" condition.

In applications where the depth of backfill is so deep that even its "Active" lateral earth pressure would exceed what a particular structure can withstand, the invention herein can be used in combination with horizontal layers of tensile reinforcement placed in the backfill in order to reduce earth pressure against the structure than would otherwise occur. FIG. 11 illustrates an example of this embodiment, along with a corresponding cross section of the invention that accommodates the necessary amount of compressive deformation to reduce lateral earth pressure as is depicted in FIG. 12. FIG. 12 provides an alternative embodiment of the invention having taller narrower peaks and valleys to achieve a more compressible shape in response to large loads induced by backfill. This shape is not necessarily ideal for standard scenarios.

The synthetic plastic cellular foam material for purposes of this invention is a solid semi-rigid material having desired density of 0.70 to 2 pounds per cubic foot, sustainable long-term compressive strength between 220 to 2,000 psf within its small (commonly 0% to 2%) range of compressive strain (seen primarily within Zone 1) by ASTM D1621 Standard Test Method for Compressive Properties of Rigid Cellular Plastics. The material composition of this invention being semi-rigid with sufficient elasticity to compress against pressures of backfill material in a time to pressure relationship as illustrated in FIGS. 3 and 5. While EPS foam according to the specification described herein is a preferred material for use in this invention, the material may comprise other types of existing synthetic plastic cellular foam material capable of the same or substantially similar behavioral features and functionalities and performing within the three ranges of stress-strain properties that deform and compress against opposing earth pressures. The three ranges of deformation and compression as described above comprising a first range (Zone 1 stress-strain behavior) providing immediate recoverable deformation, a second range (Zone 2 stress-strain behavior) providing gradual resistive compression, and Zone 3 which occurs subsequent to Zone 1 and Zone 2 deforming and compressing within the "strain hardening" range.

The shape of the peaks may be curved or geometric, or any combination of such shapes terminating with a relatively narrowed tip at its farthest end, the proportions of which are determined by analysis and/or physical testing necessary to provide the desired compressive stress-strain properties commensurate or compatible with the stress-stain characteristics of the backfill material for common or any particular buried structure applications. The preferred stress-strain properties commensurate to typical buried structures has been identified by this invention to comprise an ability of the nonplanar side of the device to compress within Zone 1 and Zone 2 range down to the base of said peaks, but without Zone 2 compression entering into the nonplanar side below said base. The nonplanar side of the device compressing primarily within Zone 1 stress-strain range of response. To achieve this diametric behavior among the two sides of the device, the height of each said peak on the nonplanar side is preferably ⅓ to 1.5 the width of its said base for the given preferred material composition and physical features of the foam material as described above.

The shape of each individual peak may not necessarily be radially symmetrical and can have asymmetric shape. More than one type of peak shape may be provided within a given amount of surface area space. Each valley space defined by its adjacent peak and serves the necessary function of breaking up continuity of said foam sheet, creating spatial separation between each peak, and allows for sufficient space between peaks for each peak element to form a tapered cross-sectional shape. This tapered shaping affect enables the foam material to properly deform in controlled manner among Zone 1, Zone 2, and potentially Zone 3 as described herein.

The system of this invention comprising use of the inventive device by its adjacent placement to a subterranean structure that is to be backfilled whereby the nonplanar side by its peak elements are in communicative contact with that side of the structure, and the planar flat surface of the planar side of this device engages with the backfill. The narrowed tips of the tapered cross-sectional shape of the peak elements in combination with the planar side of the device allows for deformation and compression to occur in timely staged manner within Zone 1 and Zone 2 within the device without being entirely overcome by the countering earth pressures to otherwise result in transfer of the differential soil load onto the structure. This is enabled by valleys interspersed between peaks which breaks up the continuum of the foam material allowing the peaks to operate throughout Zone 2 behavior, and potentially into zone 3, without Zone 2 behavior extending into the planar portion of the device (below the base of said peak elements) so that the planar portion is operating only within Zone 1.

Lateral pressure on any backfilled wall can be reduced by as much as 40% by shaping one side of EPS foam board (the non-planar side) with tapered narrowed peaks, valleys that continuously rise from another side (the planar side) that comprises a continuum of flat planar material of the same material composition as that of the non-planar side. Each peak may comprise two dimensional protrusions (or peak formations) much like lengths of ridges, each separated by another by at least one valley therebetween. Alternatively, each peak may comprise a peak island, completely surrounded by a valley space therearound between another peak island. This may be referred to as a three-dimensional peak formation. Photographs of examples of two and three dimensional embodiments comprise FIG. 13.

In applications where the depth of backfill placed on top of a buried structure would exert excessive vertical pressure upon it, the device herein can be used to reduce that pressure by its deformation inducing "stress arching" if it is used in combination with placement of a zone of aggregate backfill of sufficient width and thickness placed above the structure and the device. An example of this embodiment is illustrated in FIG. 14.

By introducing appropriate shape design to the surface of foam material, this device may be efficiently adapted to a large range of geological micro-environments, interacting with local climates that may require a large range of operating strains fluctuating seasonally and over time. Individual applications may have unique performance requirements that may include the qualities of available backfill materials, tolerance of expansive soils, ground frost heave, or geologic seismicity. The invention affords the ability to fine tune the stress-strain performance by way of a relatively thin board of EPS foam material through appropriate selection of the foam density (to which its "strength" is proportional), and the proportions of peaks (with accompanying valleys). The invention fulfills a need in the industry to provide options in geofoam technology and design to more effectively and efficiently address the variety of performance requirements of different micro-environments, while improving the environmental sustainability of construction and reducing material production and installation costs.

Note that all patents and applications referred herein are incorporated by reference in their entirety. Furthermore, where a definition or use of a term in a reference, which is incorporated by reference herein is inconsistent or contrary to the definition of that term provided herein, the definition of that term provided herein applies and the definition of the term in the reference does not apply.

DETAILED DESCRIPTION OF THE PREFERRED EMBODIMENTS

Figure 1:
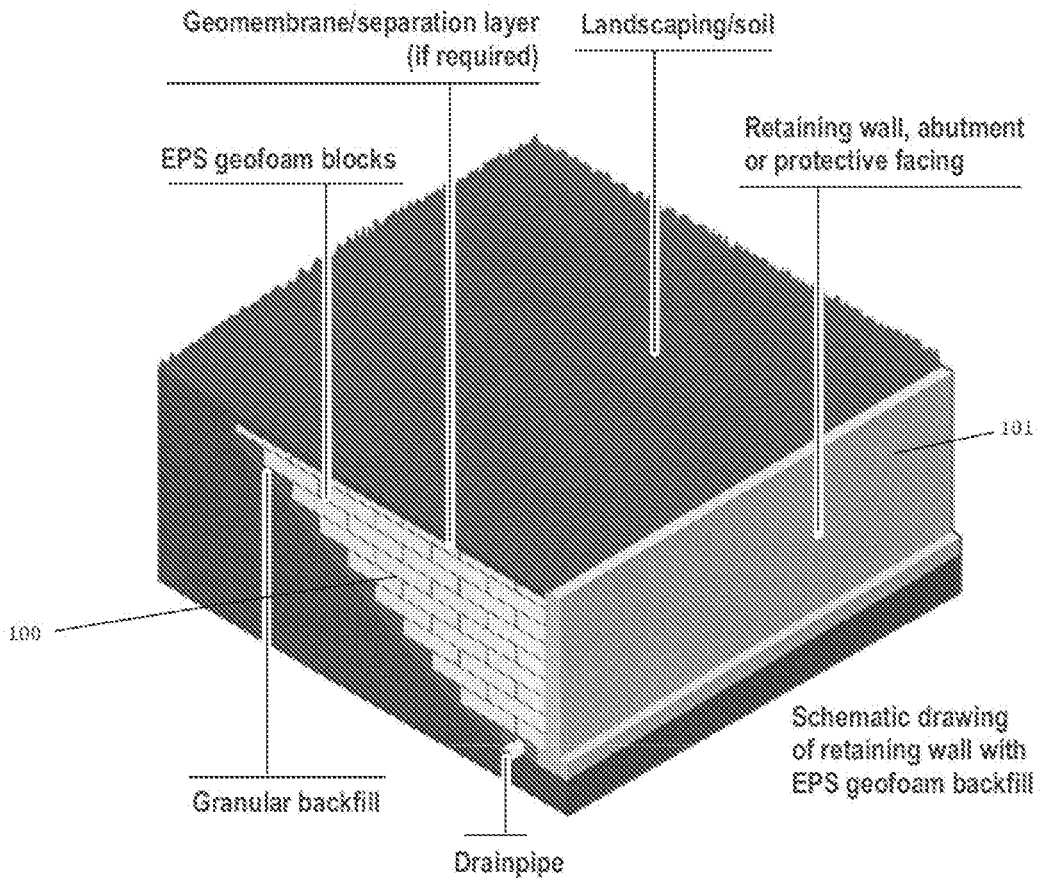
FIG. 1. Illustration of prior art device.
Figure 2:
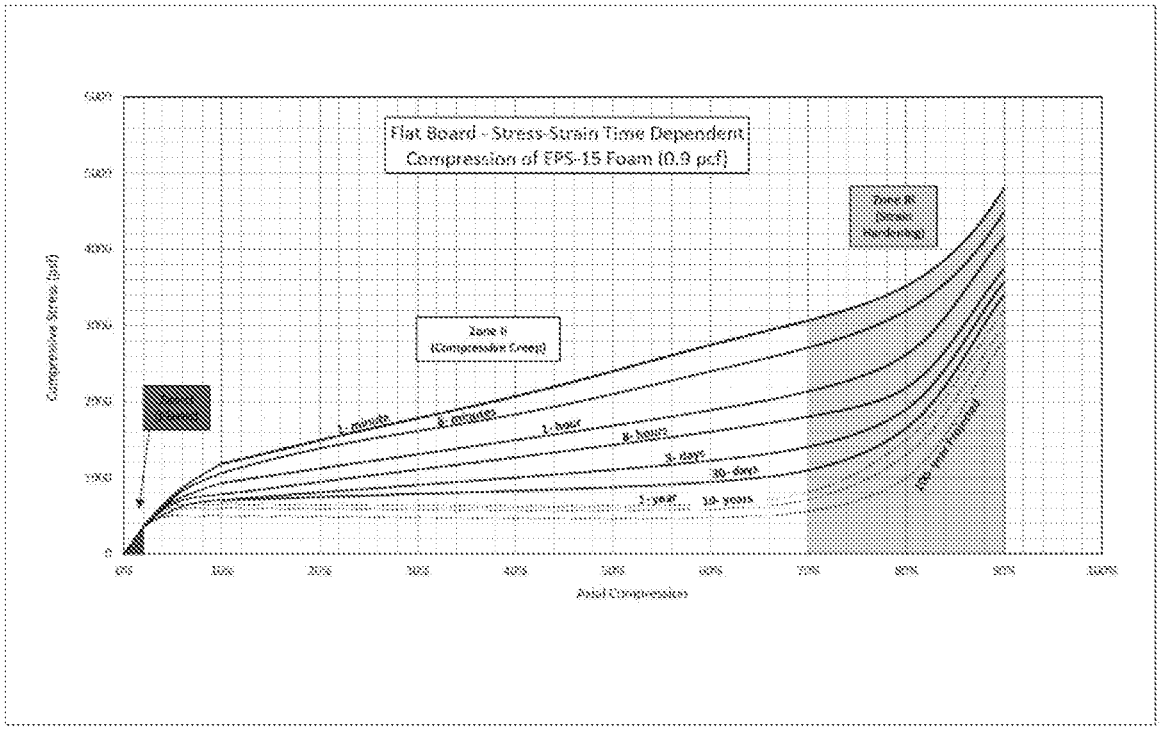
FIG. 2. Graphical illustration of flat board foam stress-strain time dependent characteristics of EPS 15.

FIG. 1 provides illustrative example of prior art geofoam device comprising large planar (rectangular) blocks of geofoam material 100. Said prior art geofoam block 100*s* are buried adjacent to underground structures 101 to an extensive degree of multiple feet which has the effect of very minimal elastic cushion against lateral and vertical earth pressures.

The inventive solution herein introduces a device, method, and system for reduction of soil pressure against a structure by controlled deformation adaptable to a variety of diverse micro-environments. The invention, according to an embodiment of FIG. 4, comprises a plurality of peaks 400 and valleys 401 rising from a base 403 on a nonplanar surface of expanded polystyrene (EPS) foam board that have proportions suitable for specific applications. The particular proportion and positioning of said plurality of peaks 400 and valleys 401 in combination with the time-dependent complex stress-strain properties of the EPS material throughout a large range of strains provide a relative and deformation effect interacting with the stress-strain properties of the soil adjacent to a structure as described by graphical illustration according to FIG. 7.

Figure 5:
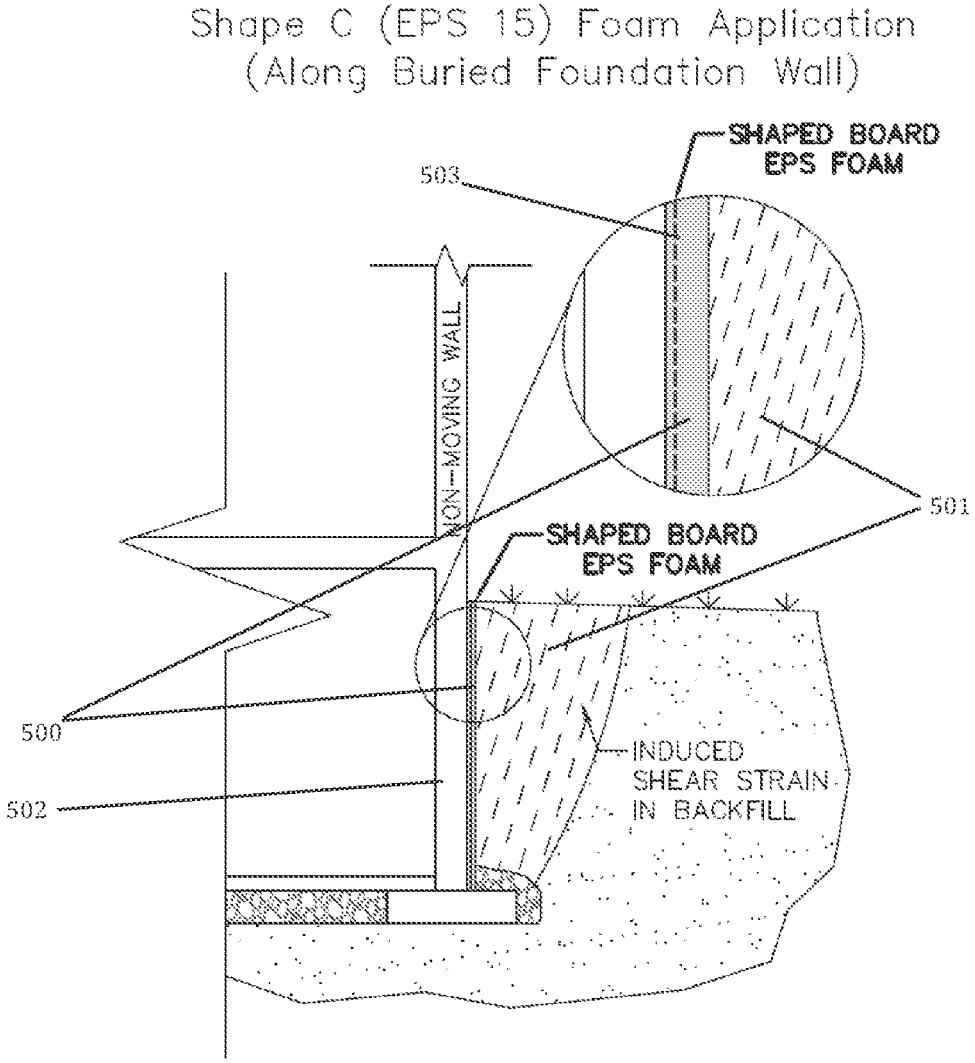
FIG. 5. A schematic cross-sectional illustration of the invention (Shaped EPS foam) placed against a buried wall.
Figure 14:
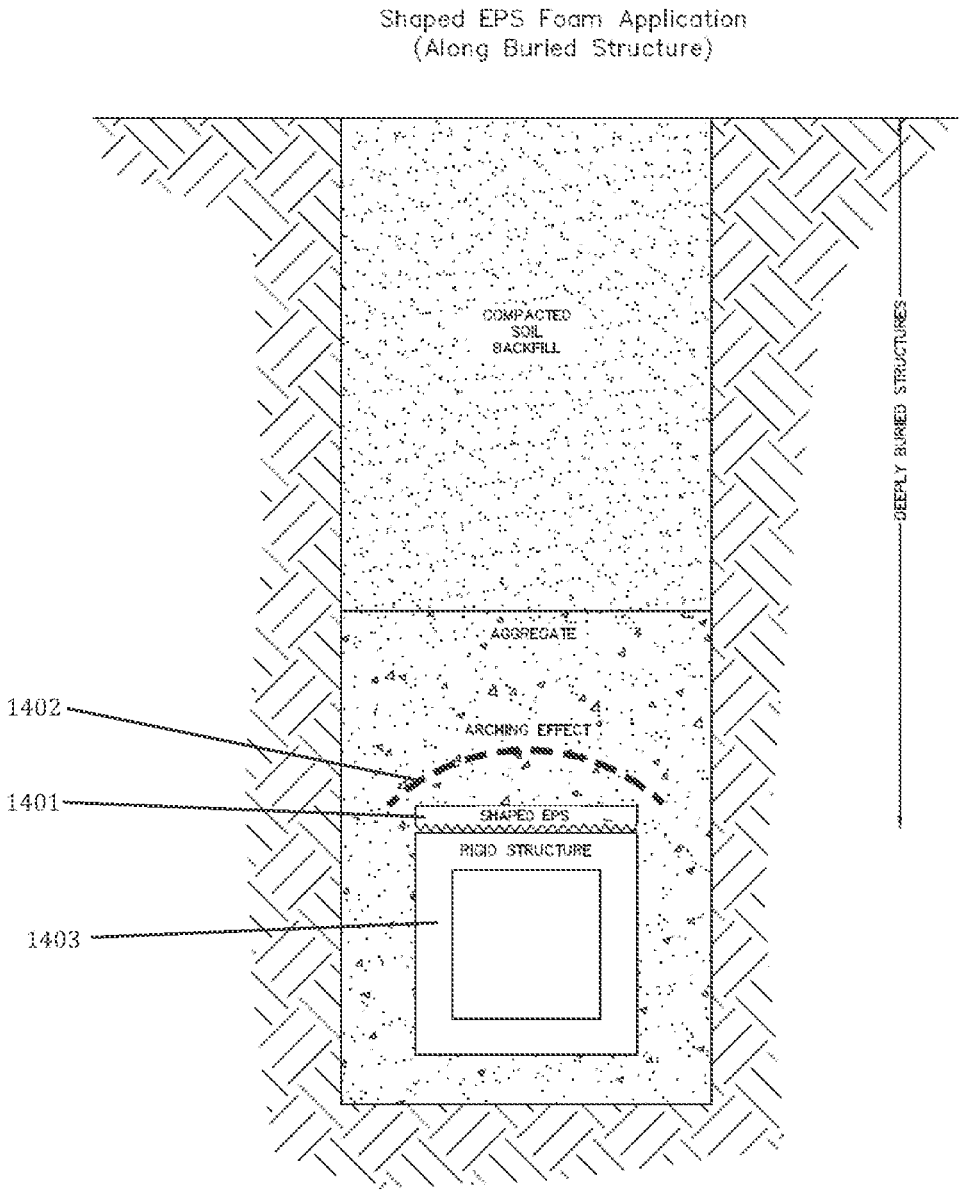
FIG. 14. A schematic cross-section sketch of shaped EPS foam placed above a rigid structure within deep excavation.

As illustrated according to FIG. 5, the particular stress-strain compressive properties of the foam device of this invention 500 must be able to manage the lateral pressure from adjacent disturbed soil 501 between its "At Rest" state through its transition to its "Active" status, serving as a sufficient compressive barrier to avoid transfer of excess soil pressure onto the buried structure 502 rearward therefrom. See FIG. 5. Similarly, as shown in FIG. 14, the device 1401 should be able to activate an effect identified as soil "arching" 1402 in backfill material over buried structures 1403, which limits vertical stress exerted by deep amounts of overburden placed above the structure 1403. See FIG. 14. In either case, the application of this invention is to reliably minimize exercise of the resistive strength of the subterranean structure as well as protect it from excessive loads that may be caused by a wide range of micro-environmental factors.

Figure 4:
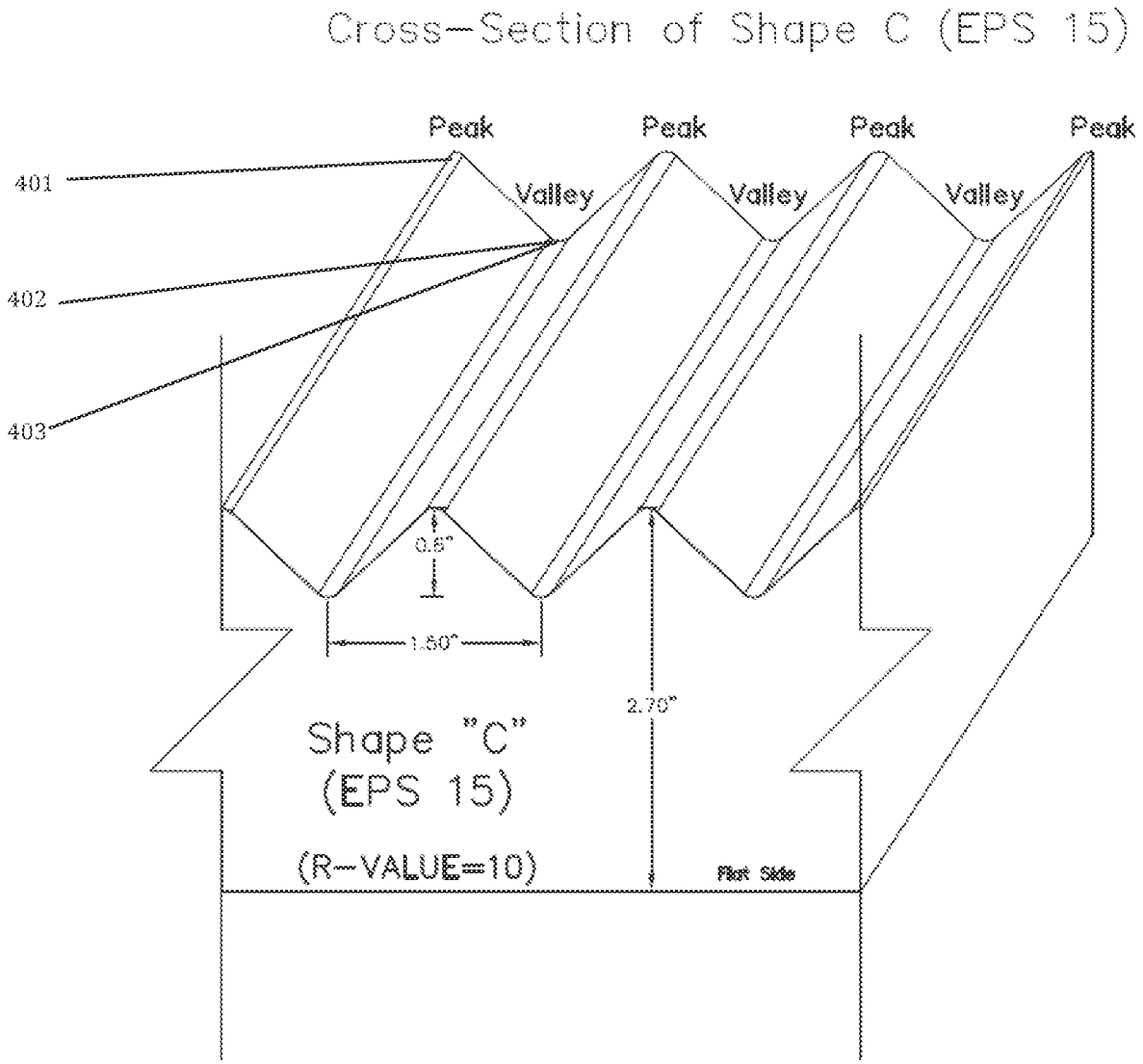
FIG. 4. Illustration of cross-sectional sketch of Invention, described as Shape C.
Figure 6:
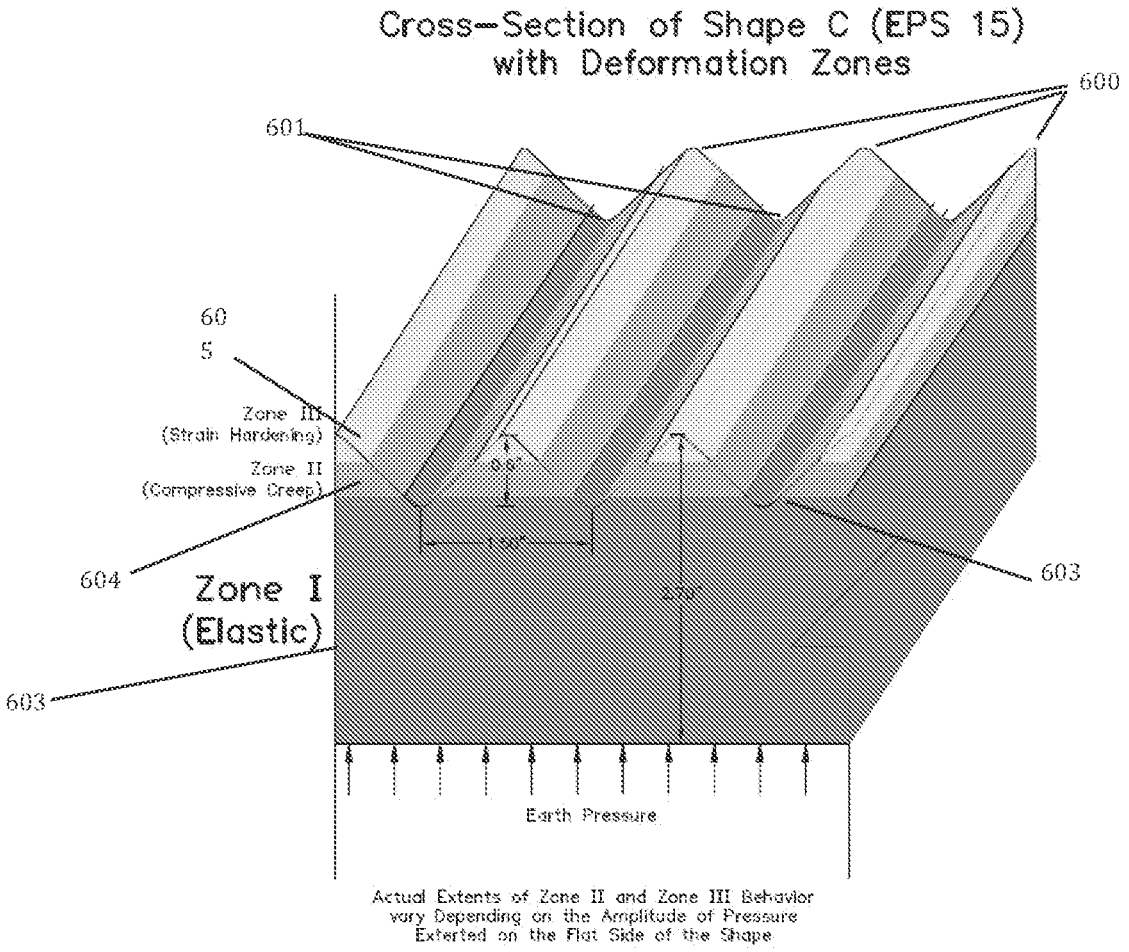
FIG. 6. Isometric Illustration of invention with zones 1, 2 and 3, described as Shape C.

To start, the invention (as illustrated in FIGS. 4 and 6) broadly relates to a plurality of peaks 400, 600 and valleys 401, 601 on compressible plastic synthetic foam material, preferably EPS foam or other type of material having similar complex stress-strain properties as described herein. The valley space 401, 601 broadly comprising an area of open space between peak elements 400, 600 that begins at the base 403, 602 of and adjacent peak element and rising therefrom. See, FIGS. 4 and 6. The compressible matter is herein discussed without limitation with respect to EPS foam. The peak 400, 600 and valley 401, 601 elements may have either a two-dimensional (adjacent to two valleys) or three dimensional (surrounded by valley space and creating a peak island) with symmetric or asymmetric cross-sectional shape. The cross-sectional shape may comprise further any rounded or geometric shape or combinations thereof. Each peak having a tapered shape that terminates at a narrowed tip end. The peak 400, 600 and valley 401, 601 elements provide a pattern of non-uniform stress distribution along the device to take advantage of the full range of the material's complex stress-strain properties. This is visually shown in FIG. 6, highlighting localized behavior along different segments of the device, performing between Zones 1 603, II 604, and III 605.

The peak elements additionally experience beyond Zone I both intermediate (Zone II) and advanced (Zone III) stress and strain to provide the desired amount of total compression needed to reduce the lateral earth pressure to a minimum possible "Active" condition using no more thickness of foam than is otherwise desired to provide thermal insulation. The peak and valley elements comprising a partial aspect of the device. The remaining portion (the planar side) comprising in fact a continuum of uninterrupted foam (planar sheet of foam material) located below the base of said peaks of the nonplanar side. This planar side portion of the device will continue to engage in the elastic range (Zone 1) in a manner similar to prior art (flat foam blocks). By effect, the device enables a concurrent combination of multiple range elastic and compression effect responding to changing soil pressure over its long-term application. The progression of this effect is illustrated in photographic images of deformation over time at constant pressure in FIGS. 8, 9, and 10. As discussed herein, the compression effect within Zone 1 and Zone 2 is experienced within the peaks but not below its base. The subject invention can also effectively and more efficiently reduce the vertical earth load on the top of buried structures by developing "arching" effects among the soil profile of the overburden as illustrated in FIG. 14.

Figure 3:
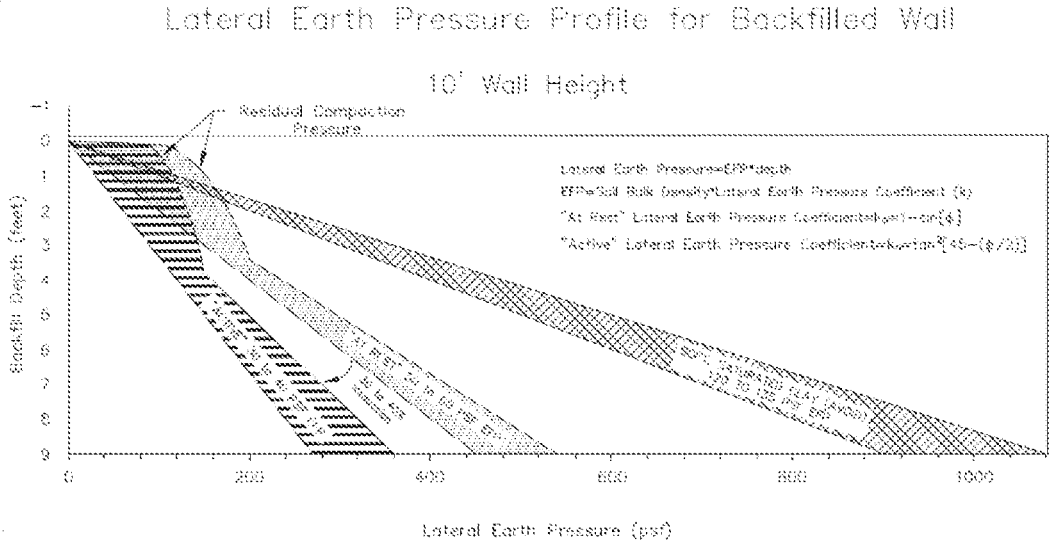
FIG. 3. Graphical illustration of lateral earth pressure profile for a backfilled wall.

Typical ranges of horizontal load exerted by backfill materials placed against walls, including residual stress from compaction of backfill during its placement compaction stresses are depicted in FIG. 3. See FIG. 3, Lateral Earth Pressure Profile for Backfilled Wall. See Chen, T., & Fang, Y., Earth Pressure due to Vibratory Compaction, Reston, Va.: *Journal of Geotechnical and Geoenvironmental Engineering* (2008, March).

The first step in developing the details of any specific application of the invention is simply to select the foam density (in this case EPS foam) of which the stress at about 1% compressive strain sustains a stress commensurate with the maximum value of application's "At Rest" lateral earth pressure profile. The next step is to presume a thickness of the continuum portion (the planar side portion) of the cross section sufficient to provide most of the desired amount of thermal insulation to the structure. Because many building codes require a minimum R-Value of 10 in temperate climate regions and the R-Value of common densities of EPS is about 4/inch of thickness, a continuum thickness of about two inches accommodates most applications because the projections and air space of the peak and valley elements provides similar amount of insulation value per inch of cross section. The final specific application design step is to develop appropriate proportions and dimensions of the projections and recesses in at least one surface of the foam board that will provide the required short and long-term stress-strain interaction with the adjacent backfill material.

Because thorough time dependent stress-strain computational analysis of the above described methodology that has non-uniform cross sectional geometry is inordinately complex, quite simple analysis based on the three zone relationship of foam for stress-strain after a large amount of elapsed time (which avoids the time-dependency of computations) allows sufficient estimation of prospective particular foam density and shapes for specific application provided it is accompanied by verification from actual testing in the laboratory. FIG. 4 depicts proportions of peaks 400 and valley 401 elements in the face of EPS 15 (0.9 pcf foam density) foam board appropriate for the range of stresses exerted by the most common range wall backfill depths. See FIG. 4, Cross-Section of Shape C (EPS 15). This is labeled as Shape C (see FIG. 4) because it is this third of several trial proportions, preceded by prior trial shapes A and B (not shown within the illustrations) in the course of developing this invention. Lab testing of shape "A" revealed that it had too long a wave length that caused the Zone II stresses to extend into a substantial portion of the continuum, which would cause excessive long-term compressive creep. Trial "B" verified appropriate wave length, but had insufficient height of peak projections for the amount of immediate and long-term compressive strain needed to sustain reduction of lateral earth pressure to the "Active" condition. Shape C has cross sectional proportions that were verified by lab testing to be effective for common residential and commercial basement walls applications, as confirmed by the long-term laboratory test results plotted in FIG. 7. See FIG. 7, Shape C Stress Controlled Compression Tests of EPS 15 Foam.

Because the three stress-strain zones within the invention's cross section shown in FIG. 6 operate in physical series with each other at all times, the creep occurring over time in Zone 2 is partially compensated by some elastic rebound within the relatively thick Zone I. And increasing amounts of "strain hardening" (Zone 3) occurs as a progressive creep accumulates over time in the narrowest portions of areas of Zone 2, limiting additional compression there over time. The combined effect of these actions results in an overall performance of the invention's cross section that is uniquely effective in minimizing lateral earth pressure by virtue of soil-structure interaction stress and strain compatibility in mobilizing the reduction of lateral earth pressure from the "At Rest" to the "Active" condition.

Figure 7:
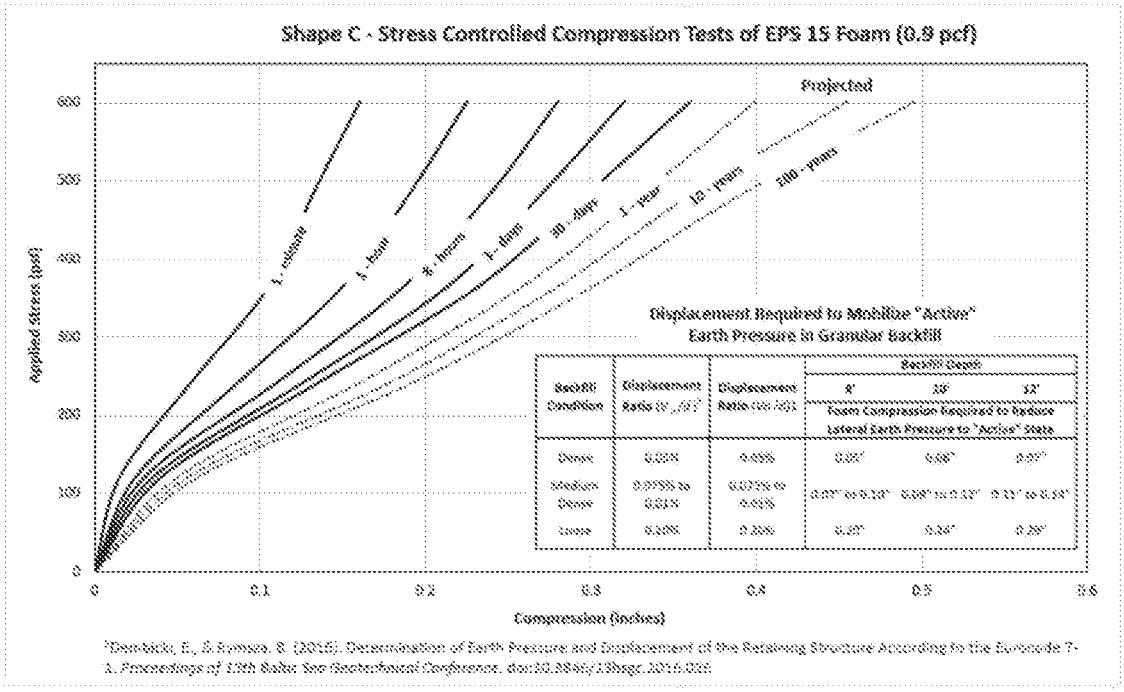
FIG. 7. Graphical illustration of stress-controlled compression test of Shape C FIG. 8. first photographic illustration of the invention.

Although the lab test results plotted in FIG. 7 include loading times only for the initial months of lab testing that has progressed to date, the longer term performance can be estimated from this test data because of the linear relationship of stress (in stain controlled test) or strain (in stress controlled tests) as plotted vs the logarithm of time that is characteristic of the invention beyond the first day of load application.

While the peak and valley elements in the surface of the foam board could be formed during manufacture of the foam material, it's commonly most economical to cut ("hot wire") them because these relatively thin, shaped sheets are being cut from large blocks of foam that are commonly four feet thick, about four feet wide, and sixteen to eighteen feet long. In order to prevent the relatively high stress-strain performance of the foam material's cross-sectional shape from extending into the continuum of the material in order to maintain a relatively uniform, low stress-strain field within that continuum, the peak elements must have a base width that is substantially less than the thickness of the continuum. And the height of the projections must be sufficient to provide much of the total compressive deformation that is required to mobilize reduction of earth pressure. Because compacted clay as well as granular soils have their own time-dependent stress-strain properties the design of the invention's projections and recesses must also take those properties into consideration to provide long term backfill interaction compatibility with the invention. This may include accommodation of ground frost heave, expansive soil swell, seismic acceleration of soil, as well as soil arching effects in vertical load applications.

Figure 13:
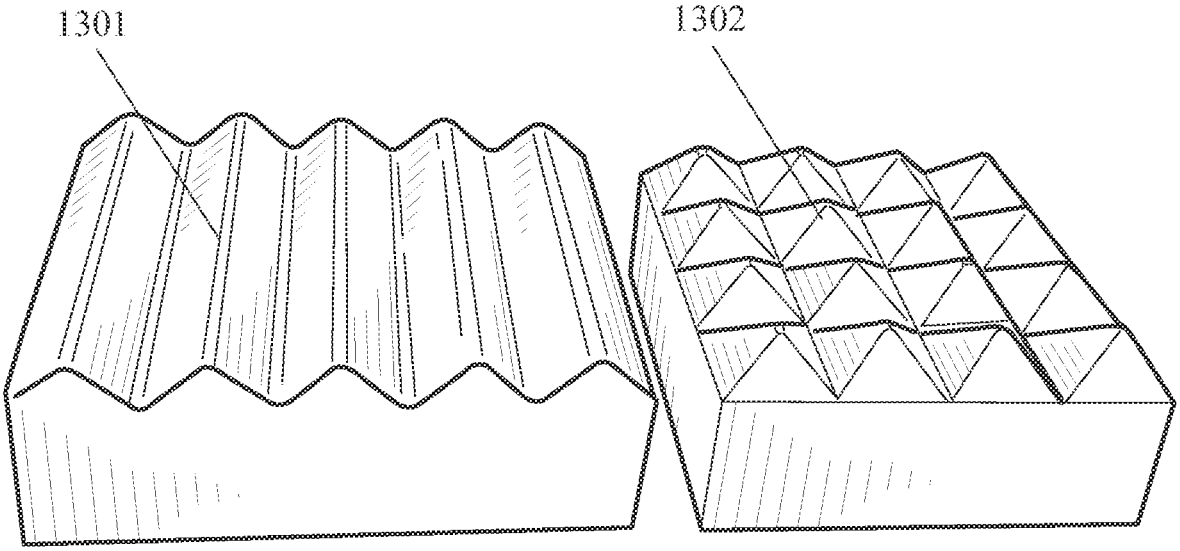

FIG. 4 depicts the specific portions developed by the inventor for use of EPS grade 15 that are effective in providing sufficient strain in buried wall backfill materials to mobilize reduction from the "At Rest" to the lessor "Active" earth pressure for common wall heights ranging from eight to twelve feet. It turns out that a two-dimensional pattern of peaks and valleys provides soil-structure stress-strain compatibility with common backfill materials. The principles exercised by the invention provide the basis to develop other specific shapes, which can include three-dimensional valleys and peaks (see FIG. 13, 1301, 1302), as may be required to provide compatibility with the soil-structure interaction characteristics of additional specific applications. See FIG. 6, Isometric Sketch of invention shape C.

Figure 8:
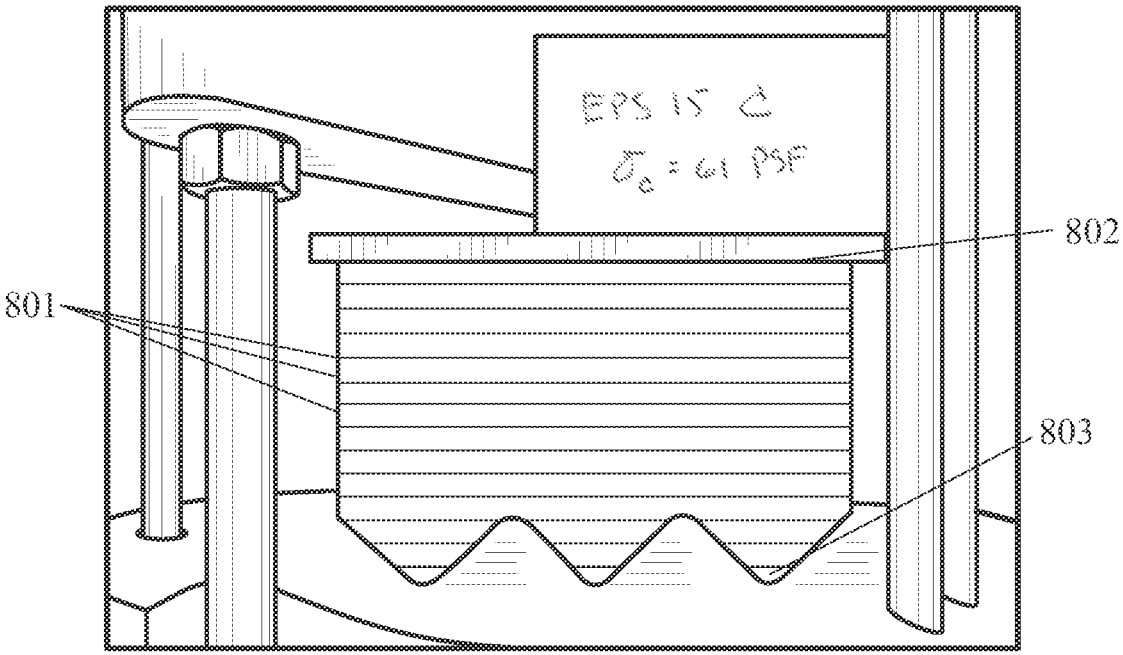
Figure 9:
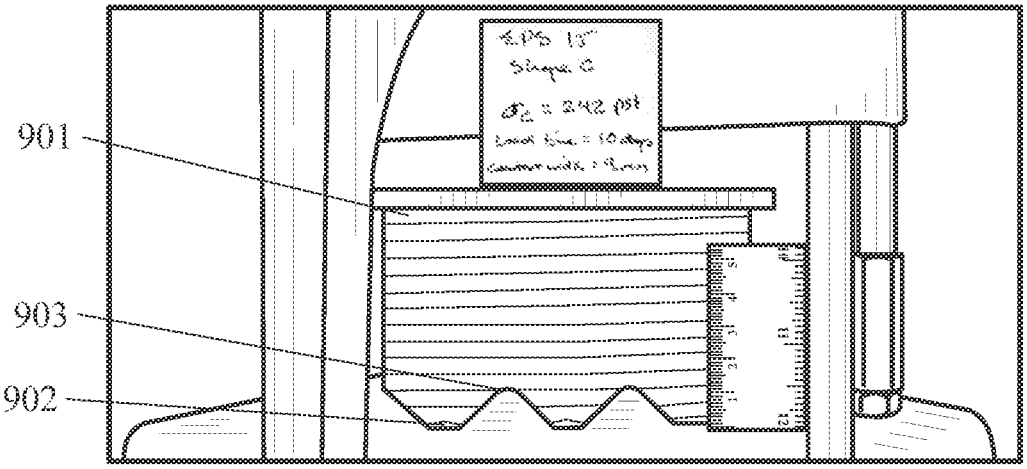
FIG. 9. A second photographic illustration of the invention.
Figure 10:
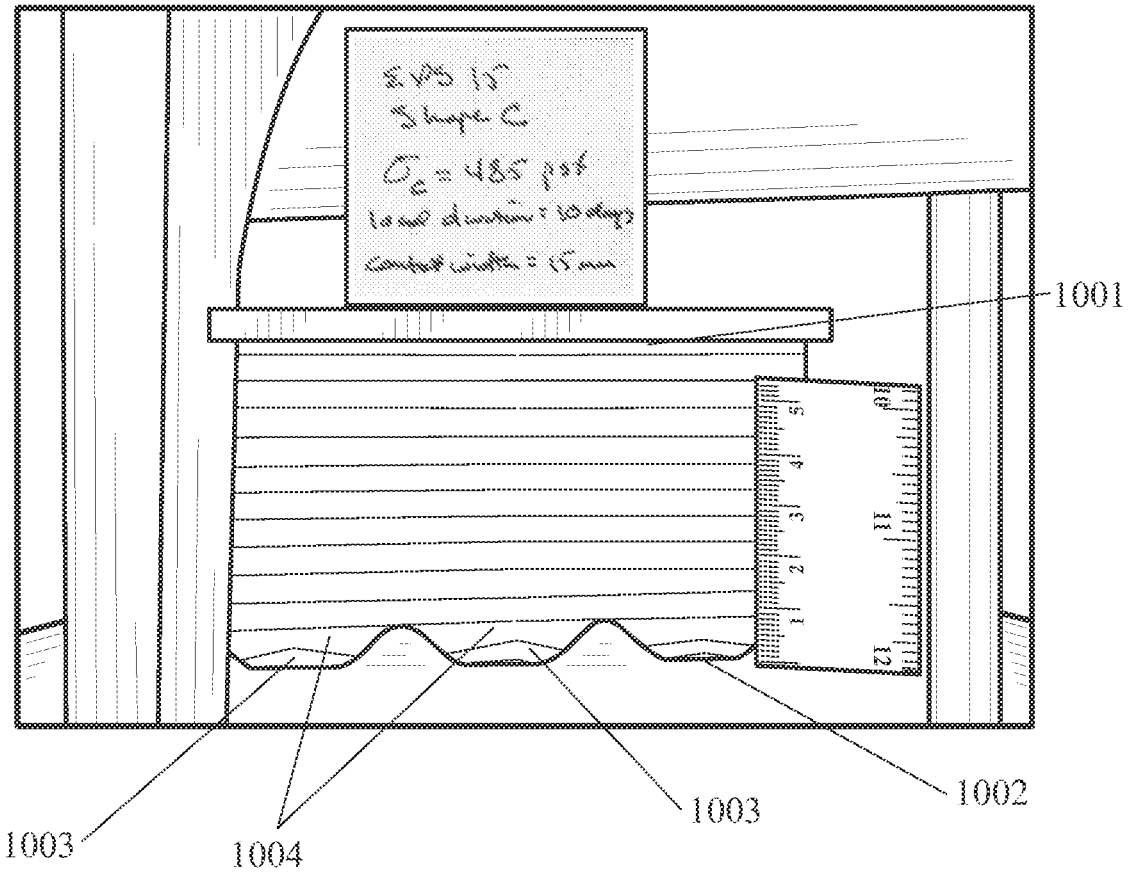
FIG. 10. A third photographic illustration of the invention.

The following photographs of FIGS. 8, 9, and 10 are of the ongoing stress-controlled lab compressive lab tests being performed to verify long term performance of the invention. Results of these tests to date are the data from which FIG. 7 was generated. FIG. 8 depicts the shape C of an EPS 15 sample before appreciable load is applied. FIG. 9 shows the distribution of compression across the sample's cross section at a common range of final ("Active" lateral earth pressure) long term stress in common applications. FIG. 10 shows the amount of compression the same sample experiences under the initial, short term load beginning with the "At Rest" lateral earth pressure condition as backfill is placed but the "Active" earth pressure is not yet mobilized.

In actuality, the maximum amount of compression that EPS shape C will initially compress is in between what is shown in FIGS. 9 and 10.

In FIG. 8, lines 801 spaced 0.2 inches apart were drawn onto this cross-sectional view of EPS 15 shape C prior to installing the sample in the stress-controlled compression apparatus used in the long-term lab testing performed in the course of developing this invention. The flat surface of the planar (toward the top as installed in this test apparatus) side of the sample 802 measures 4.5 inches square, to which this initial load of just 61 psf is applied. The width of contact stress at the tips 803 of the peaks (toward the bottom in the apparatus) is just 4 mm at this light load, so the tips (at about 600 psf contact stress) are not loaded much beyond the elastic limit at even this location. As such, very little compression of the tips has occurred as can be seen here.

In FIG. 9, the sample is loaded to 242 psf at the flat surface of the planar side 901, which is toward the lower range "Active" lateral earth pressure with a depth of wall backfill of about eight feet. The tips 902 of the peaks are quite compressed as is evident from the curvature of the original straight lines that had been drawn on the sample. At this load the contact stress of the tips 902, now 9 mm wide, is about 1,020 psf. So the tips 902 are stressed into Zone 2 (compressive creep with time) range of behavior, while the wider base of the peaks 903 is still within the Zone 1 (elastic) range of stress.

In FIG. 10, the sample is loaded to 485 psf on the flat surface 1001 of the planar side of shape C of EPS 15. This is equivalent to the "At Rest" lateral earth pressure with a depth of wall backfill of about eight feet. The tips 1002 of the projections are now very compressed into the range of "strain hardening" (Zone 3). The mid-height portion of the projections 1003 is stressed to about 1,200 psf (Zone 2), while the rest of the test sample comprising the continuum is still within the elastic (Zone 1) stress range 1004.

A preferred embodiment according to FIG. 5 utilizes the invention as a board of EPS foam 500 placed with its shaped face 503 against the vertical outside face of a structural wall 502 to form an appropriately compressive layer between the wall and the backfill material 501 that reduces the lateral earth pressure profile exerted against the wall from the "At Rest" to the "Active" condition. Use of the invention in this manner as shown in FIG. 5 is preferable to the present common practice of using flat sheets of XPS foam insulation board that are inherently too rigid to activate any substantial reduction of lateral earth pressure. See FIG. 5, Schematic cross section sketch of the invention (Shaped EPS foam) placed against a buried wall.

Figure 11:
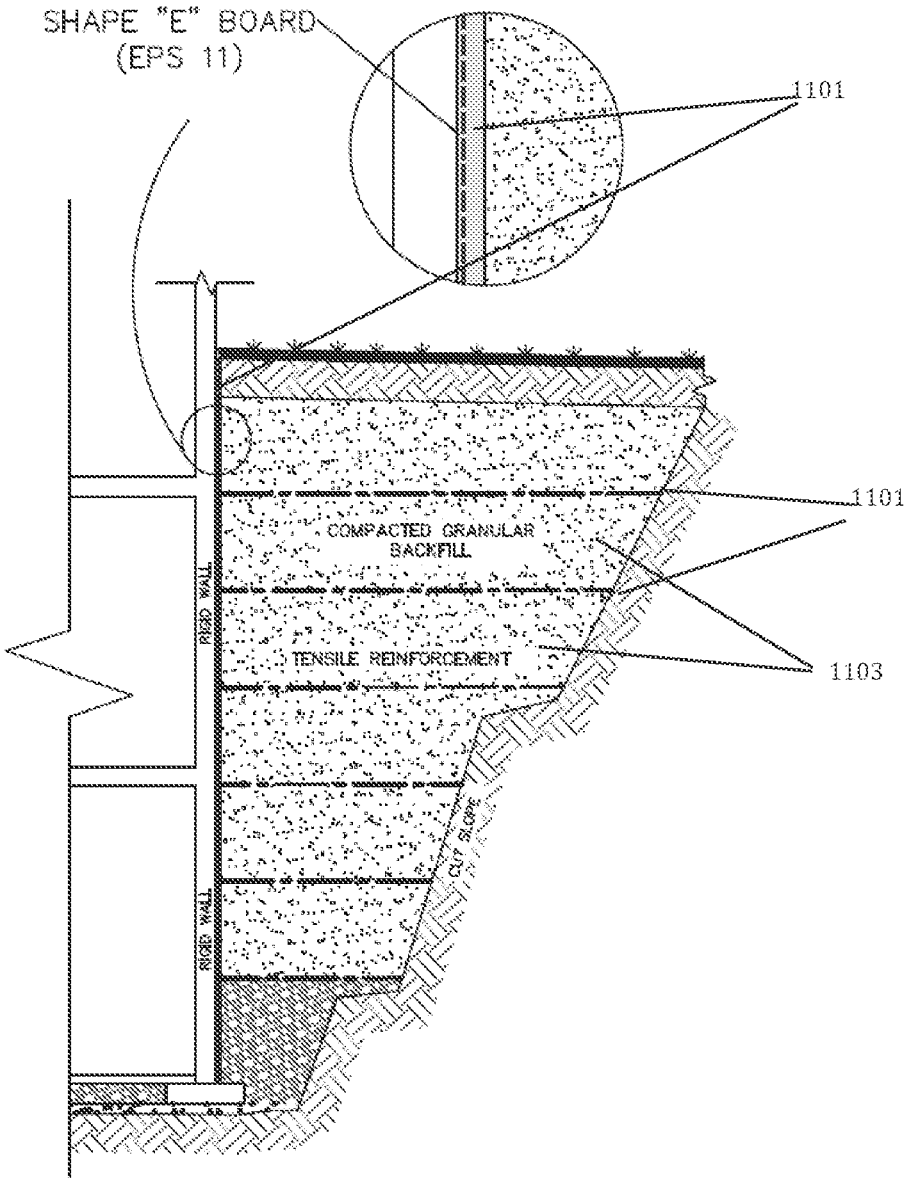
FIG. 11. A schematic cross-sectional illustration of shaped EPS Foam placed against a deeply buried wall.
Figure 12:
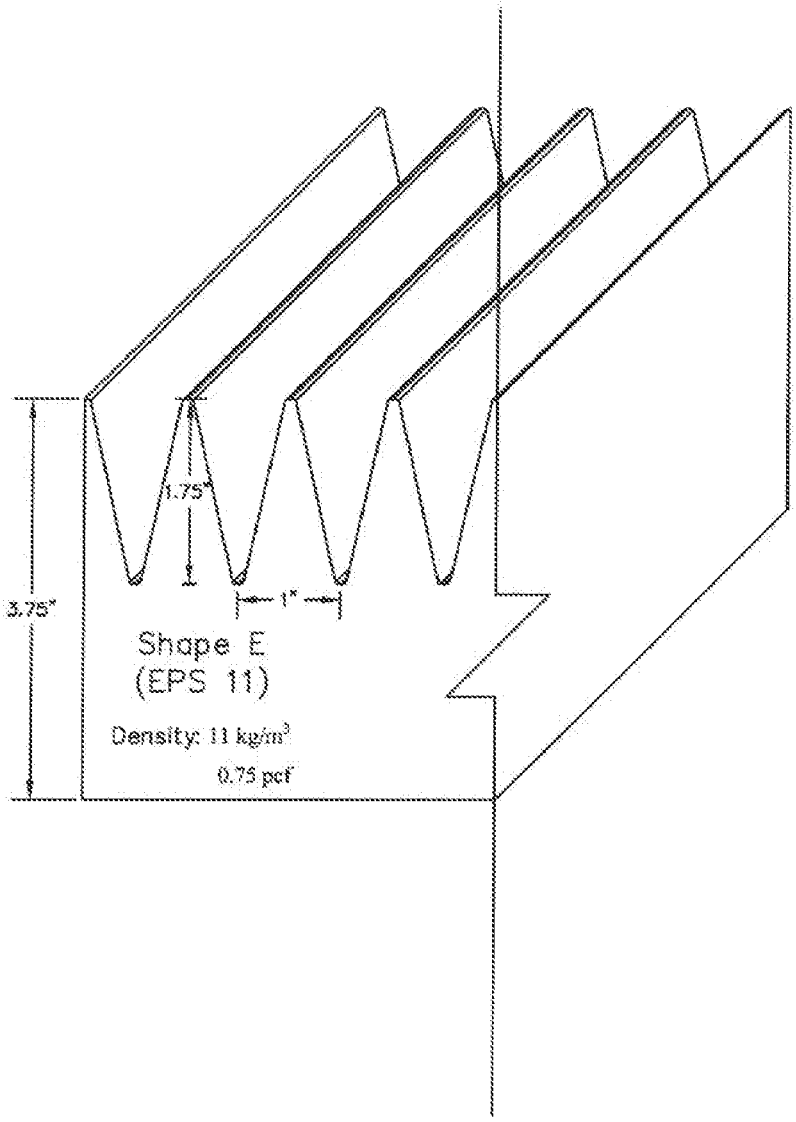
FIG. 12. Illustration of cross-sectional sketch of Invention, described as Shape E FIG. 13. A first and second alternate embodiment of the invention.

For applications, as illustrated in FIG. 11, that require a backfill depth of more than ten or twelve feet, the next efficient step to reduce lateral earth pressure is to install horizontal layers 1101 of very high modulus tensile reinforcement within the backfill as it is placed in compacted lifts. This is a well-established geotechnical practice. In this case, the invention 1102 can also be used to additional advantage to minimize the lateral earth pressure caused by each "cell" 1103 (the vertical space between each layer of tensile reinforcement) of the backfill as depicted in FIG. 11. See FIG. 11, Schematic cross section sketch of shaped EPS Foam placed against a deeply buried wall.

Another embodiment as illustrated in FIG. 14 utilizes the invention 1401 as a board of EPS foam placed with its shaped face 1401 against the top of a deeply buried structure 1403 in order to activate "arching" effects 1402 within aggregate backfill placed above the structure and thereby greatly reducing the vertical pressure exerted by the backfill placed over the structure. Use of the invention in this manner is preferable to using a substantially thicker "inclusion" of EPS board or block operating only within the foam material's Zone 1 quite limited elastic response range. See FIG. 14, Schematic cross section sketch of shaped EPS foam placed above a rigid structure within deep excavation.

The present invention is best understood by reference to the detailed figures and description set forth herein.

Embodiments of the invention are discussed herein with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements, dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

The invention claimed is:

1. A system for reducing earth pressure on buried portions of a rigid stationary structure by utilizing a geofoam device as follows:

said geofoam device comprising a solid sheet of synthetic plastic cellular foam material having a first planar side and a second non-planar side, said first planar side having a flat planar surface and said second non-planar side providing a plurality of peaks and valleys, each said peak having a tapered cross-sectional shape starting at a base and terminating at a narrowed tip, each said valley defined by the space between two adjacent peaks, said first planar side having a depth of at least 1.0 inch, said second non-planar side having a depth of at least 0.5 inch between the base and tip of each peak of said plurality of peaks, wherein the total thickness of said solid sheet of synthetic plastic cellular foam material between the depths of its said first planar side and second non-planar side is at least 1.5 inches thick, whereby said second non-planar side of said geofoam device is positionable to be in contact with the surface of the buried portion of said rigid stationary structure such that the tips of the plurality of peaks of said second non-planar side are compressible and deformable against said buried surface, the flat planar surface of said first planar side of said geofoam device is further positionable to be facing towards backfill earth material, such that the force from the of pressure of said backfill earth material in its unsettled state against said first planar side causing said first planar side to be deformable and compressable within Zone 1 stress-strain behavior and causing said second nonplanar side to be deformable and compressable within Zone 1 and Zone 2 stress-strain behavior against said buried portion of said rigid stationary structure wherein zone 1 is an elastic zone and zone 2 is a compressive creep zone.

2. Said system for reducing earth pressure on buried portions of a rigid stationary structure by utilizing a geofoam device as described in claim 1 wherein the tips of said plurality of peaks of said second nonplanar side are further deformable and compressable towards a "strain hardening" range (Zone 3 stress-strain behavior range) subsequent to compressing past Zone 1 and Zone 2 stress-strain behavioral ranges.

3. A system for reducing earth pressure on buried portions of a rigid stationary structure by utilizing a geofoam device as follows:

said geofoam device comprising a solid sheet of synthetic plastic cellular foam material having a first planar side and a second non-planar side, said first planar side having a flat planar surface and said second non-planar side providing a plurality of peaks and valleys, each said peak having a tapered cross-sectional shape starting at a base and terminating at a narrowed tip, each said valley defined by the space between two adjacent peaks, said first planar side having a depth of at least 1.0 inch, said second non-planar side having a depth of at least 0.5 inch between the base and tip of each peak of said plurality of peaks, wherein the total thickness of said solid sheet of synthetic plastic cellular foam material between the depths of its said first planar side and second non-planar side is at least 1.5 inches thick, wherein the initial stress-strain condition of the lateral earth pressure in its "at rest" state acting against said first planar side of said geofoam device causing said first planar side to be immediately deformable in recoverable manner and subsequently deformable with gradual resistive compression at the tips and mid-height range to the base of said plurality of peaks and portions of said second non-planar side, whereby the degree of lateral earth pressure of a backfill material that is acting against said geofoam device is reducible from its initial higher pressure "at rest" state to a lower pressure "active" state.

4. A method for reducing earth pressure on buried portions of a rigid stationary structure by utilizing a geofoam device as follows:

said geofoam device comprising a solid sheet of synthetic plastic cellular foam material having a first planar side and a second non-planar side, said first planar side having a flat planar surface and said second non-planar side providing a plurality of peaks and valleys, each said peak having a tapered cross-sectional shape starting at a base and terminating at a narrowed tip, each said valley defined by the space between two adjacent peaks, said first planar side having a depth of at least 1.0 inch, said second non-planar side having a depth of at least 0.5 inch between the base and tip of each peak of said plurality of peaks, wherein the total thickness of said solid sheet of synthetic plastic cellular foam material between the depths of its said first planar side and second non-planar side is at least 1.5 inches thick, whereby the initial stress-strain condition of the earth pressure in the higher pressure "at rest" state is reduced to a lower pressure "active" state without impact of a differential load upon said rigid stationary structure, said method comprising the steps of first placing said geofoam device adjacently to the surface of said rigid stationary structure that is to be buried wherein said second nonplanar side is in contact with that surface and said first planar side faces towards the area where backfill earth material will be placed, secondly backfilling earth material against said first planar side of said device, thirdly wherein said second nonplanar side of said device deforming and compressing within its elastic range (Zone 1) and its compressive creep range (Zone 2) beginning at the tips towards mid-height range and towards the base of said second nonplanar side in response to the unsettled earth pressures.

5. Said method of claim 4 wherein the tips of said plurality of peaks of said second nonplanar side further deforming and compressing towards a "strain hardening" range (Zone 3 stress-strain behavior range), subsequent to compressing past Zone 1 and Zone 2 stress-strain behavioral ranges in response to said unsettled earth pressures.

* * * * *